United States Patent [19]

Morris

[11] Patent Number: 4,591,094

[45] Date of Patent: May 27, 1986

[54] FOUNTAIN

[76] Inventor: Arthur Morris, 1 E. Row, Whinneybanks, Middlesbrough, United Kingdom

[21] Appl. No.: 640,391

[22] Filed: Aug. 13, 1984

[30] Foreign Application Priority Data

Aug. 13, 1983 [GB] United Kingdom ..... 8321864
Dec. 9, 1983 [GB] United Kingdom ..... 8332864

[51] Int. Cl.[4] ..... B05B 17/08; B05B 15/10; F21P 7/00

[52] U.S. Cl. ..... 239/17; 239/20; 239/204

[58] Field of Search ..... 239/17, 20, 23, 203, 239/204, 205, 206, 310, 318, 416, 417, DIG. 16

[56] References Cited

U.S. PATENT DOCUMENTS 1,652,372 12/1927 O'Brien ..... 239/417
1,965,323 7/1934 Taslitt ..... 239/20
3,312,400 4/1967 Clearman ..... 239/206
3,533,553 10/1970 Britzman ..... 239/17
3,813,043 5/1974 Mordehai ..... 239/204

*Primary Examiner*—Jeffrey V. Nase
*Assistant Examiner*—Patrick N. Burkhart
*Attorney, Agent, or Firm*—Ross, Ross & Flavin

[57] ABSTRACT

A fountain, suitable in particular for use in domestic locations, comprises a generally vertical fluid inlet tube, a spray tube surrounding the fluid inlet tube and free to move linearly in the direction of the length of the latter, the spray tube being open at its lower end and having at least one flow-restricting orifice at its upper end, and a liquid container surrounding the spray tube. A pump may be provided to feed fluid, e.g. air or water, to the fluid inlet tube. Liquid ejected from the orifice or orifices may be collected in a catchment vessel and returned to the liquid container for recycling.

4 Claims, 7 Drawing Figures

FOUNTAIN

My invention is a novel form of fountain, suitable in particular for domestic locations such as inside the home or in the garden but also of value in public areas such as pedestrian precincts or gardens.

Fountains or conventional types require a steady supply of water, preferably at constant pressure or at a pressure which varies only within restricted limits. Thus in a domestic setting in particular, fixed or flexible water supply pipes must be provided. It may then be necessary to choose between the inflexible option of fixed pipes (which may be buried) and the visually less attractive option of flexible pipes, which generally have to be left in view. It is therefore not surprising that fountains are seldom seen in indoor domestic settings.

My invention, by contrast, is a fountain which does not require a piped supply of water.

The fountain according to my invention comprises a generally vertical fluid inlet tube, a spray tube surrounding said fluid inlet tube and free to move linearly in the direction of the length of the latter, said spray tube being open at its lower end and having a flow-restricting orifice at its upper end, and a liquid-tight container surrounding said spray tube.

By means of my invention, a water display may be achieved using a limited quantity of water in a closed circuit arrangement, the only continuous supply required being a fluid supply. The fluid supply in turn need not be piped but can be produced in situ using a suitable fluid pump. In operation, the fluid enters the spray tube via the fluid inlet tube, the spray tube rises and produces the desired spray via the flow-restricting orifice, while simultaneously drawing in water at its open lower end, and, if desired, the sprayed water is collected and recycled to the water-tight container.

The fluid used to supply the fluid inlet tube and thereby operate the fountain may conveniently be air or water. The choice of fluid may be made to take account of the different advantages available in the use of different fluids. Thus if the fluid is water, then the water supply may be taken from the water-tight container and pumped direct to the inlet tube by means of a pump located adjacent to said container. Because a water pump may operate more quietly than an air pump, the fountain itself may be made more quite in this way. An air pump in general is cheaper than a water pump but in some situations, for example when the fountain is intended to be used on a table in the home, the more expensive but quieter water pump may be preferred.

Preferably the linear movement of the spray tube is restricted at least at the lower limit of its movement and possibly also at its upper limit. Thus a stop may be provided, for example in the form of a collar surrounding the fluid inlet tube, to limit the extent of downward vertical movement of the spray tube over the fluid inlet tube. Alternatively, the downward movement of the spray tube may be limited either by the lower end of the spray tube abutting the base of the liquid-tight container or by the inside of the upper end of the spray tube abutting the upper end of the fluid supply tube.

The upward movement of the spray tube is, of course, countered by its own weight and in general this will be a sufficient restriction on that upward movement. However, a collar may be provided to surround the spray tube and, by abutting against a fixed stop, limit further upward movement. Another favourable influence over the effects produced by my fountain may be obtained by varying the overall weight of the moving unit consisting of the spray tube and the orifice-containing nozzle. This may be achieved by providing one or more weights, designed to fit upon or about the spray tube, for example to surround its upper end, so that the resistance to the air or water pressure within the tube may be increased or reduced.

If desired, the spray tube may also be free to rotate about its axis. In one form of my invention, rotation of the spray tube about its axis is deliberately induced, for example by appropriate orientation of the flow-restricting orifice or by means of fins or vanes, for example spiral fins on the outside of the spray tube, which induce rotation in response to linear movement of the spray tube. Similar effects may be produced by siting a vane or baffle within the spray tube, the effects in this case being generated by the continuous flow of water and/or air upwards through the tube.

Although the shape of the liquid-tight container is not critical, in one preferred form of my invention the container is itself cylindrical and means are provided to position the spray tube generally axially within the container, such that the linear movement of the spray tube around the fluid inlet tube is in the direction of the cylinder axis.

As already indicated, my novel fountain may be self-sufficient so far as water is concerned. On way of recycling the water is to surround a relatively compact fountain with a catchment bowl, which may for instance be mounted upon the upper end of the liquid-tight container and which may guide water, which has been sprayed through the flow-restricting orifice, back into the container. An alternative is to locate the container surrounding the spray tube within a mass of water, for example a garden pond, extensive enough to catch water which has been sprayed. The container then need not itself be strictly water-tight, the pond now fulfilling that function, water from the pond being reintroduced to the container for subsequent recycle.

When the water is recycled, it is desirable that a suitable filter be included in the system to remove any solid material which has been picked up by the water. In the case where the container is located within a pond, the filter or filters may be incorporated in the wall of the container.

Provision may usefully be made to ensure that unusually high pressures in my fountain, for example from a surge in the fluid flow or as the result of a blockage, do not cause damage. With this in mind, a pressure-relieving aperture may be located in that part of the fluid inlet tube which is normally surrounded by the spray tube. When an exceptional increase in fluid pressure then causes the spray tube to rise sufficiently to uncover the aperture, the excess pressure is readily released via the aperture.

As will be apparent, the flow-restricting orifice is an essential feature of my invention. However, it is not necessary that there should be only one orifice. Indeed, various enhanced effects may be produced by having a plurality of such orifices. For example, side-arms of the spray tube may extend laterally, especially in a generally radial direction, and flow-restricting orifices may then be located along and/or at the end of said side-arms. If the orifices open in a generally upwards direction, then attractive vertical sprays are produced, which may inter-engage or otherwise cooperate to produce a variety of possible patterns. If the orifices are located in the sides of the side-arms, then the liquid sprays may cause rotation of the spray tube and may at the same time produce other visual effects. If the side-arms are designed to be rotationally adjustable about their own axes, then the angle of inclination of the orifices to the vertical may be changed and the rate of angular rotation of the spray tube may thereby be varied. In another form of my invention, orifices specifically orientated to produce rotation may be coverable or uncoverable at will by collars slidably mounted on the side-arms, to afford further control over the variety of effects which my fountain can produce.

The fountain according to my invention may be used simply for decorative purposes but is readily adaptable to other uses. For example, it may be located in a shallow pond or play pool as a play fountain for children. In its rotary form, it may be decorated or otherwise modified to appear as a carousel. Suitably decorated it may function as a visually-arresting advertising display.

My invention will now be further described with reference to the accompanying drawings, which illustrate various embodiments of the fountain according to my invention by way of example. More specifically:

Figure 1:
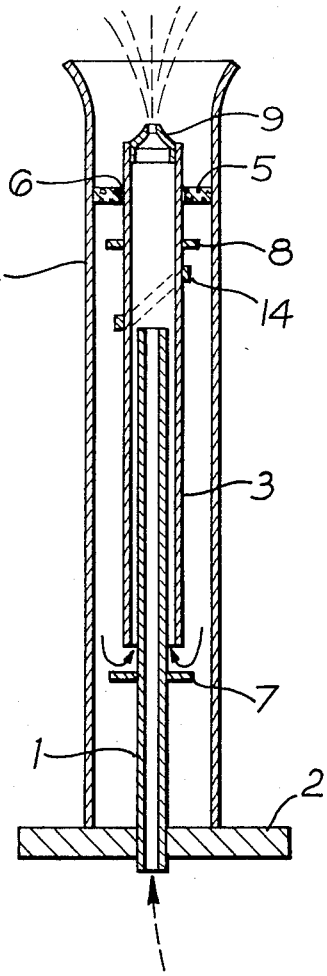
FIG. 1 is a vertical sectional view of a first form of fountain according to my invention.

Referring firstly to FIG. 1, the fountain therein illustrated, which is suitable for use in a garden pool, has a vertically disposed air inlet tube 1 which is supported by, and passes through, a stand 2 which is the base for the fountain as a whole. Surrounding air inlet tube 1 is a spray tube 3 which in turn is surrounded by a cylindrical, liquid-tight container 4. The spray tube 3 is guided in a position which is generally axial with respect to the container 4 by a disc 5 of filter material, having a central aperture 6 within which the spray tube 3 is an easy sliding fit. A collar 7 on the air inlet tube 1 acts as a support and lower stop for the spray tube 3 and seals the lower end of the tube 3 when the latter sits upon it. Upward movement of the spray tube 3 is limited by a further collar 8, which is carried by the tube 3 and abuts the disc 5 when the spray tube 3 is in its highest position.

The upper end of spray tube 3 carries a spray nozzle 9, which is retained by screw threads and is interchangeable for alternative nozzles producing different liquid spray patterns.

In operation of the fountain, the container 4 is filled with liquid, for example water. Air is supplied to the air inlet pipe in the direction of the broken arrow and as a result increases the pressure within the spray tube 3. The tube 3 is lifted and water enters the lower end of tube 3 in the direction of the solid arrows.

Under pressure of air in the tube 3, water is sprayed from the nozzle 9 and produces a fountain display. Air continuously enters the tube 3 via air inlet tube 1 and water continuously enters tube 3 via its lower end. The fountain display is thus maintained.

Some at least of the sprayed water falls back into the container 4 and filters through disc 5, subsequently to be recycled through the spray tube 3 and nozzle 9. The supply of water may be further maintained in various ways. Thus, for example, the whole fountain unit may be placed within a garden pond. Sprayed water falling on the pond may then be returned to the container 4, preferably via suitable filters (not shown), which may if desired be located in the wall of the container 4.

Figure 2:
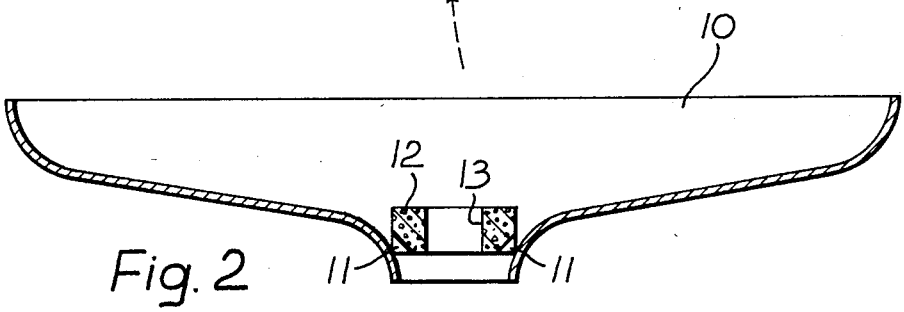
FIG. 2 is a vertical sectional view of a catchment bowl suitable for use with the fountain of FIG. 1.

Alternatively, particularly where the fountain is to be used indoors, a catchment bowl such as that shown in FIG. 2 may be fitted to the upper end of the container 4. The bowl, designated by the numeral 10, is of sufficient diameter to catch all water sprayed by the nozzle 9. The water then drains back into the container 4 via drainage holes 11 in a filter plug 12, which is located at the centre of the bowl 10 and itself has a central aperture 13, sized to provide additional guidance for the spray tube 3.

Additional or alternative fountain effects may be achieved by inducing rotation of the spray tube 3. Two optional, alternative ways of producing this result are shown:

In FIG. 1, a spiral fin 14 is shown on the outer surface of spray tube 3. As the tube 3 rises and falls under the influence of the air supply via air inlet tube 1, the fin 14 causes the spray tube 3 to rotate.

Figure 3:
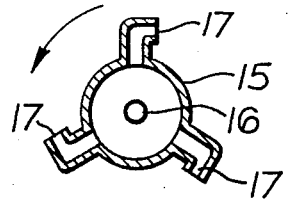
FIG. 3 is a horizontal sectional view on a larger scale of an alternative nozzle for use with the fountain of FIG. 1.

FIG. 3 illustrates a nozzle 15 with a central spray hole 16 and with three additional, tangentially-directed jet holes 17. When the nozzle 15 is fitted in replacement of the nozzle 9, ejection of water through the jet holes 17 induces rotation of the spray tube 3 in the direction of the arrow.

In a further modification, not illustrated, a number of bleed-holes are provided in the upper end of the spray tube 3, above the disc 5. An adjustable collar surrounding the tube 3 may then be moved to cover one or more or all the bleed-holes so as to vary the pressure within the tube 3 and thereby modify the spray.

Alternative fountain effects may be produced by using coloured water or scented water. Furthermore, antiseptic water or deodorant liquid may be used.

Figure 4:
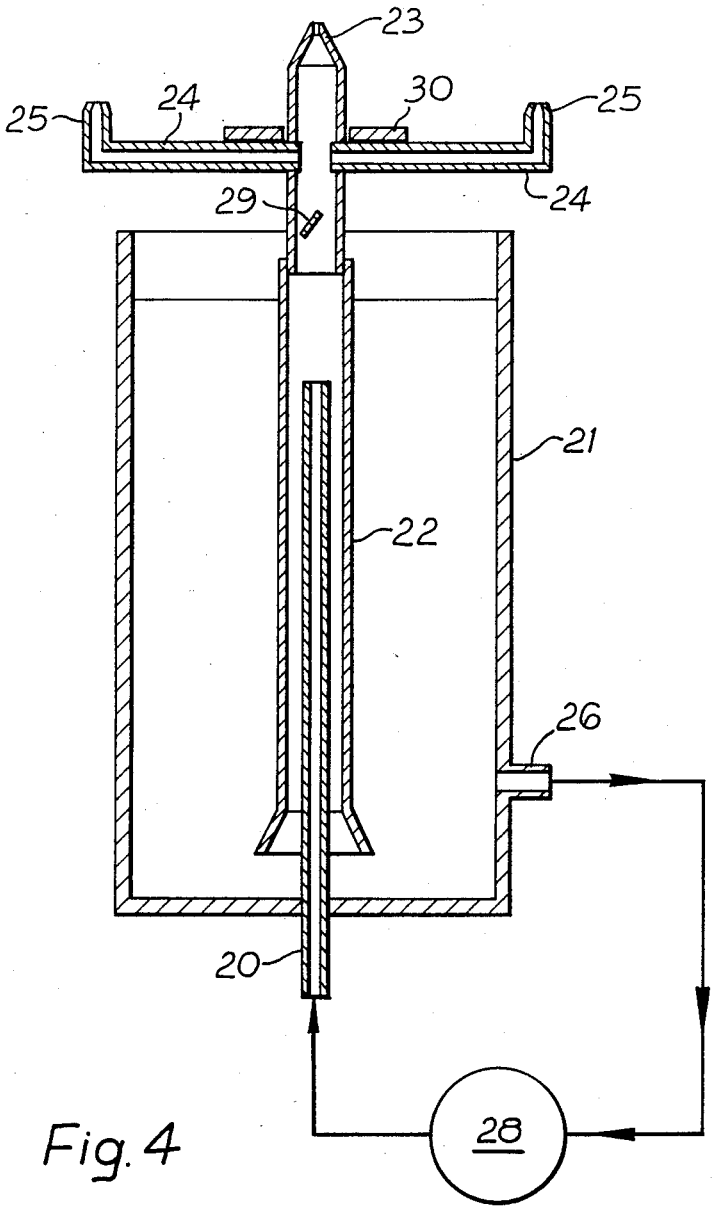
FIG. 4 is a vertical sectional view, which is in part diagrammatic, of a second form of fountain according to my invention.

Referring now to FIG. 4 of the accompanying drawings, the fountain there shown comprises a water inlet tube 20, which extends through a seal in the base of a water-tight container 21 and is surrounded by a spray tube 22. The upper end of the spray tube 22 carries a spray assembly comprising a central nozzle 23 and radial arms 24 terminating in nozzles 25. A water outlet 26 allows water to be drawn from the container 21 and circulated via a water circuit 27, by means of a pump 28, and fed continuously to the water inlet tube 20. The flow of water lifts the spray tube 22 and gives rise to jets from the nozzles 23 and 25. Optionally provided is a vane 29, located inside the spray tube 22. If the vane is provided, then the water flow upwards in the spray tube impinges on the vane 29 and causes the spray tube 22 and spray assembly to rotate, addding to the visual effect of the jets from the nozzles 23 and 25.

The effect may be further modified by placing an annular weight 30 around the nozzle 23 and by interchanging the weight 30 with other larger and smaller weights.

Figure 5:
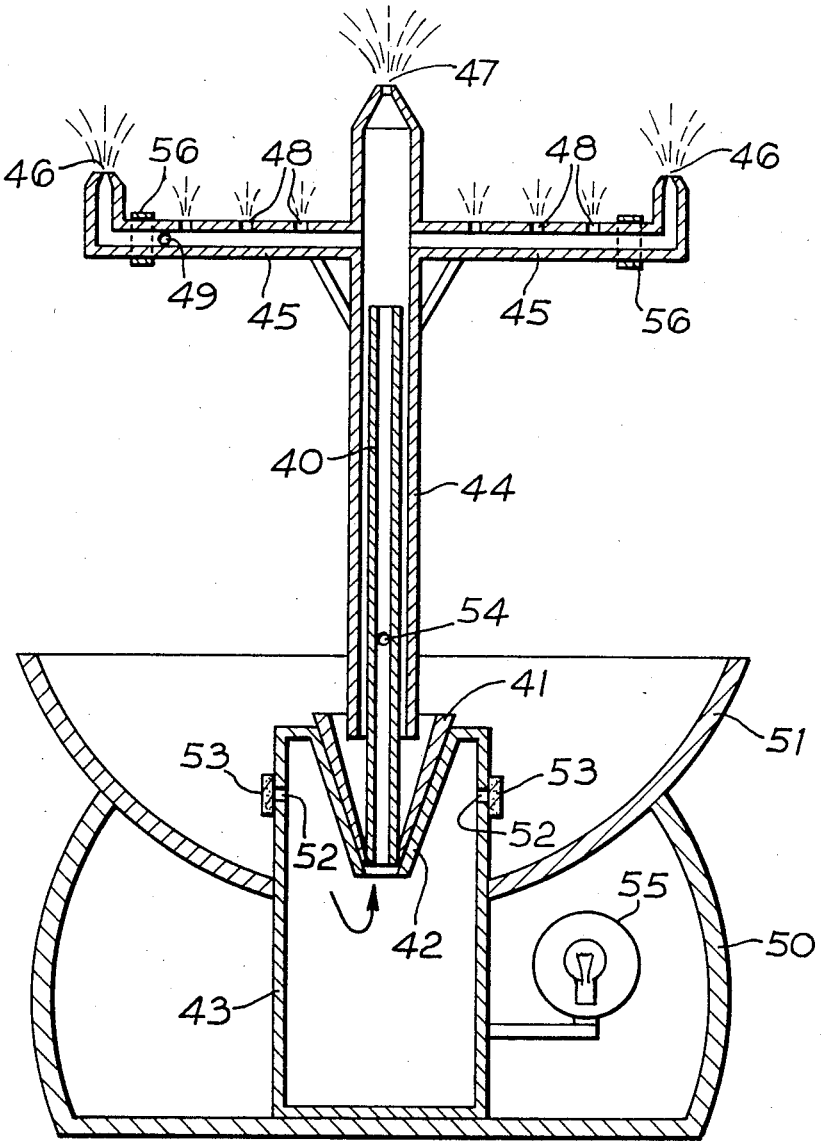
FIG. 5 is a vertical sectional view of a third form of fountain according to my invention.

The fountain illustrated in FIG. 5 is designed for indoor domestic use, for example placed upon a table.

This fountain includes a water inlet pipe 40, axially secured at its lower end to a frustoconical component 41 which mates with a tapered socket 42 to permit ready assembly and dismantling of the fountain and also allows alternative or replacement inlet pipes to be fitted. The socket 42 is part of a pump housing 43, which contains a water-pump (not shown) to feed water into the lower end of the water inlet pipe 40.

Axially surrounding the inlet pipe 40 is a spray tube 44, which carries at its upper end a spray head comprising four radial spray arms 45, each terminating in a nozzle 46, and a central spray nozzle 47. The spray arms 45 are perforated down their length by upward-facing jet orifices 48 and each arm 45 further has a side-facing orifice 49. The orifices 49 are so disposed that they all face the same rotational direction relative to the axis of the spray tube 44. Each orifice 49 may be covered by a slidable collar 56.

The assembly comprising the housing 43, the water inlet pipe 40 and the spray tube 44 and spray head is mounted upon a flat-bottomed base 50 and is surrounded by a catchment dish 51 placed to collect a major part of the water discharged from the spray head. Water so collected in the dish 51 is returned to the pump via return apertures 52, each covered by a filter pad 53 to remove any entrained foreign matter from the water.

A decorative electric lamp bulb 55 is contained within the housing 50.

The whole unit illustrated in FIG. 5 is placed in a decorative water bowl and the latter is filled with water, which may be coloured, scented and/or otherwise modified, to a level above the upper edge of the catchment dish 51. Artificial flowers may be floated in the bowl to enhance the effect and a decorative artificial flower may be mounted upon the dish 51 to reduce splashing from water falling back from the spray head into the dish. The spray head may be caused to rotate by exposing the orifices 49 by sliding back the collars 56.

Any excess pressure of water in the spray tube 44 is released via a relief aperture 54 in the inlet pipe 40, which aperture 54 is uncovered when the excess water pressure raises the spray pipe to a sufficient extent. In this way it is ensured that such pressure does not blow off the spray assembly from the inlet pipe.

Figure 6:
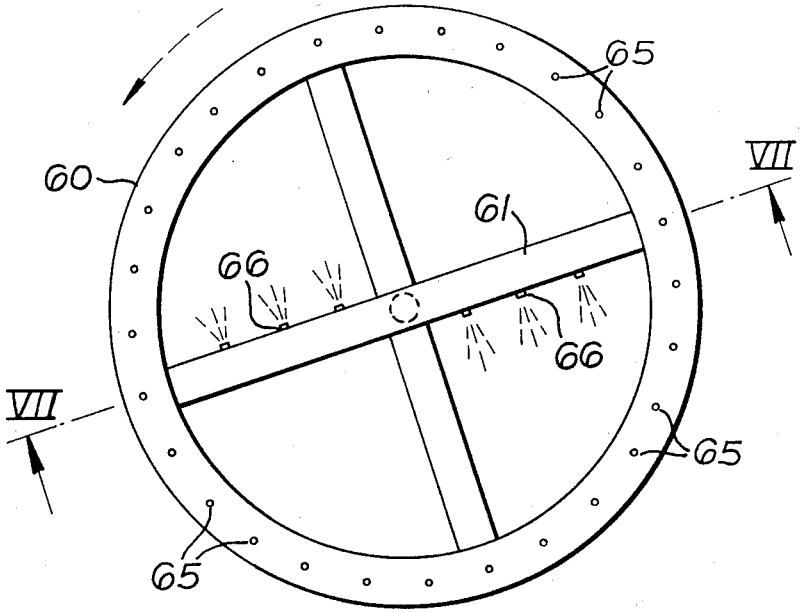
FIG. 6 is a plan view of an alternative form of spray head for use with a fountain according to my invention.
Figure 7:
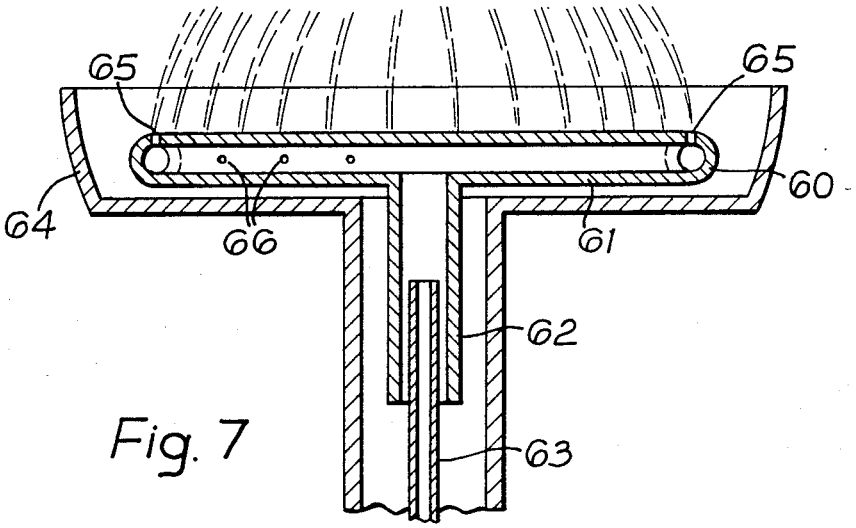
FIG. 7 is a vertical sectional view on the line VII—VII of FIG. 6.

The further form of spray head shown in FIGS. 6 and 7 is an annulus 60, fed by a diametrically-disposed feed tube 61, mounted transversely on the top of a spray tube 62. The spray tube 62 is fed by a water inlet pipe 63 and these two components are in turn surrounded by a catchment dish 64. The pipe 63 and dish 64 are both shown in FIG. 7 but are omitted from FIG. 6 in the interests of clarity. The annulus 60 has a number of spray orifices 65, which point either directly upwards or alternatively in a slightly inwardly-inclined direction to produce together a canopy of water over the centre of the spray head. The feed tube 61 has side orifices 66 which eject water and cause the spray head to rotate in the direction indicated by the broken-line arrow in FIG. 6.

What is claimed is:

1. In a fountain comprising:

(a) a generally vertical, elongated fluid inlet tube;

(b) a spray tube means coaxially surrounding said fluid inlet tube and mounted so as to be linearly freely movable in the direction of the length of said fluid inlet tube;

(c) said spray tube further being open at its lower end and defining, between said lower end and said fluid inlet tube, a generally annular aperture for admission to said spray tube means of a liquid to be sprayed;

(d) at least one flow-restricting orifice disposed at a upper end of said spray tube to restrict a flow of liquid from said spray tube;

(e) a liquid container surrounding said spray tube to supply liquid to said spray tube through the generally annular aperture; and (g) a fluid pump to pump fluid into said fluid inlet tube; whereby, during operation of said fountain, fluid pressure between said fluid inlet tube and said upper end of said spray tube means causes said liquid to be drawn into said generally annular aperture for subsequent ejection from said at least one orifice, and further wherein said fluid pressure causes said linear movement of said spray tube means.

2. In a fountain according to claim 1, wherein an open-topped liquid catchment vessel is disposed around said liquid container to receive at least a major portion of any liquid ejected from said at least one flow-restricting orifice and said catchment vessel communicates with said liquid container to permit liquid to flow from said vessel to said container.

3. In a fountain according to claim 1, wherein said fluid pump is an air pump.

4. In a fountain according to claim 1, wherein said liquid container is in communication with said fluid inlet tube via a flow circuit incorporating a liquid pump.

* * * * *